US005799730A

United States Patent [19]

Lam et al.

[11] Patent Number: 5,799,730

[45] Date of Patent: Sep. 1, 1998

[54] WELLHEAD CASING HANGER ASSEMBLY

[75] Inventors: Tony M. Lam; Abram Khazanovich, both of Edmonton; John Braben, St. Albert, all of Canada

[73] Assignee: Stream-Flo Industries Ltd., Canada

[21] Appl. No.: 727,872

[22] Filed: Sep. 18, 1996

[51] Int. Cl.[6] ..... E21B 33/00

[52] U.S. Cl. ..... 166/75.14; 166/88.3

[58] Field of Search ..... 166/75.14, 86.1, 166/88.2, 88.3, 207, 217; 285/142, 146, 147

[56] References Cited

U.S. PATENT DOCUMENTS

| | | | |
|---|---|---|---|
| 3,134,610 | 5/1964 | Musolf | 166/88.3 X |
| 3,438,654 | 4/1969 | Jackson, Jr. et al. | 166/88.3 X |
| 5,031,695 | 7/1991 | Cain et al. | 166/75.14 |
| 5,031,696 | 7/1991 | Zwiegel . | |
| 5,342,066 | 8/1994 | Henley et al. . | |

OTHER PUBLICATIONS

Catalog Sheet published by FMC Corporation of Chicago, entitled "Slip–Type Casing Hangers" showing a C–29 model.

*Primary Examiner*—William P. Neuder
*Attorney, Agent, or Firm*—Sheridan Ross P.C.

[57] ABSTRACT

Opposed pairs of sockets are formed by the bottom surface of the slip housing and the top surface of the bottom ring of a casing hanger assembly. Vertical holes are provided in the elastomer seal element which is sandwiched between the slip housing and bottom ring. Each pair of sockets and corresponding seal element hole form a socket chamber. Rigid, motion-limiting pins are positioned in the socket chambers. Each pin has side and bottom clearances with the chamber side and bottom walls. The pins are therefore initially free floating, to allow the seal element to move to accommodate oversized casing; but the pins take up the casing load as the slip housing descends and limit its downward travel, thereby preventing excessive compression of the seal element, which can lead to casing damage.

4 Claims, 3 Drawing Sheets

FIG. 3a.
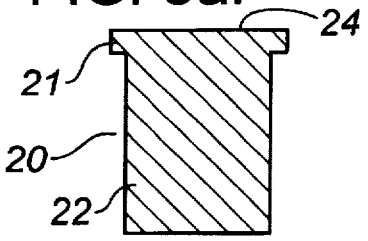
FIG. 3b.
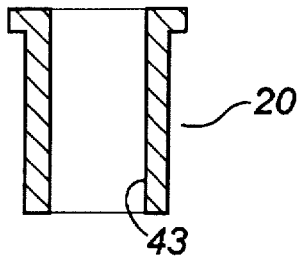
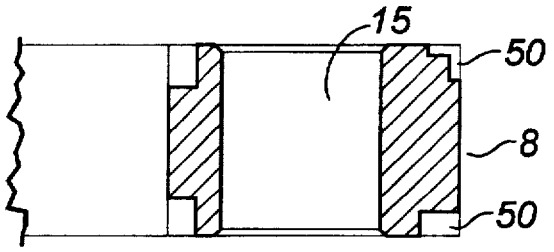
FIG. 4.
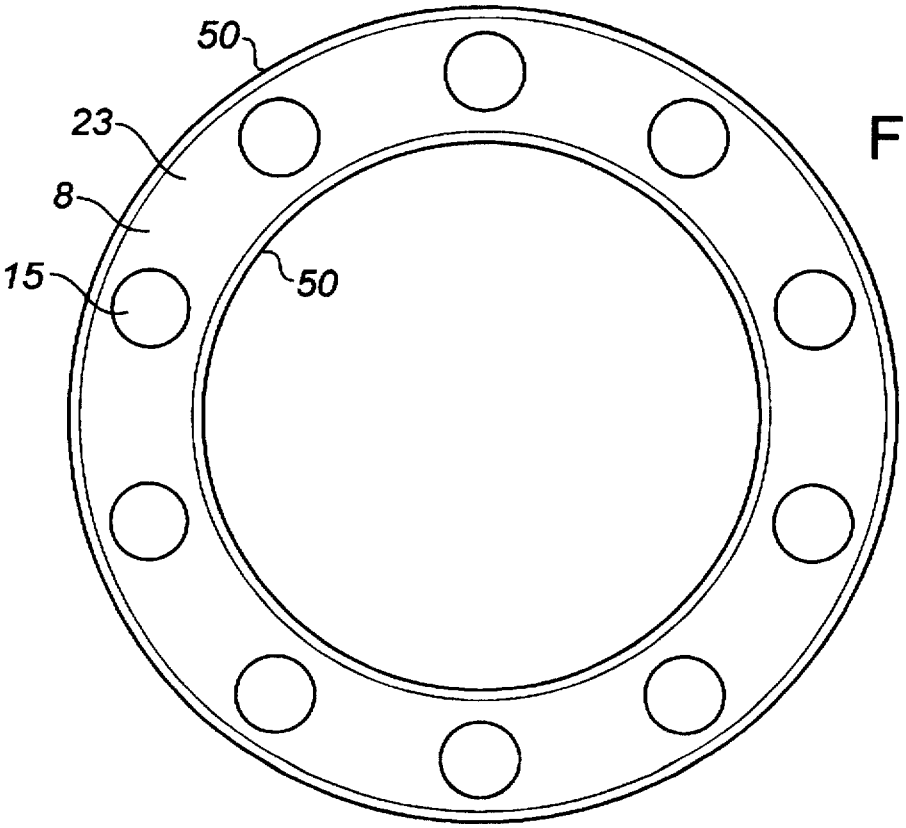
FIG. 5.

WELLHEAD CASING HANGER ASSEMBLY

FIELD OF THE INVENTION

This invention relates to a casing hanger assembly of the type used to suspend casing from the casing bowl of an oilfield wellhead.

BACKGROUND OF THE INVENTION

It is conventional oilfield practice to attach a casing bowl to the upper end of the large diameter surface casing string of a well and to then suspend a second smaller diameter casing string from the casing bowl. The conventional means for engaging and suspending the second casing string from the casing bowl is a casing hanger assembly. This annular assembly seats on and is supported by an internal annular landing shoulder formed by the casing bowl. The assembly is split vertically into two halves which are joined by a hinge, so that it can be positioned around the casing.

The conventional casing hanger assembly comprises:

- a steel bottom ring that seats on the casing bowl landing shoulder;
- an annular elastomer seal element seated on the bottom ring;
- an annular steel slip housing seated on the seal element;
- the slip housing having an inwardly tapered, axial bore surface; and
- a set of slips supported by the slip housing, each slip having a tapered outer surface that conforms with the tapered surface of the slip housing and a vertical serrated inner surface or face.

The serrated faces of the slips engage the top end of the second casing string as it is being set down. The slips slide downwardly and inwardly a short distance when loaded with the casing, by interaction with the tapered surface of the slip housing. They engage and suspend the casing string from casing bowl landing shoulder. The weight of the casing string is transferred through the slips, slip housing, seal element and bottom ring to the casing bowl.

As weight is taken by the slip housing, it compresses the seal element. This causes the seal element to extrude radially to seal against both the inner surface of the casing bowl and the outer surface of the suspended casing string.

It is known to provide stops to limit downward travel of the slip housing. Otherwise there would be excessive compression of the seal element. If this were to occur, lateral loading of the casing could cause the casing to be crushed due to the large loading involved.

U.S. Pat. No. 5,031,696, issued to Zweigel, teaches providing steel pins or pedestals positioned in vertical holes extending through the seal element. The pedestals have a height less than that of the seal element. The pedestals are free floating in the element holes. When the seal element is partly compressed between the slip housing and bottom ring, the pedestals take up the load and transfer it from the slip housing to the bottom ring. The pedestals are free to move laterally with the seal element, to evenly distribute stress across the seal element. They are not connected to either the bottom ring or slip housing and thus are said to be "free floating".

It is to be noted that Zweigel's assembly is characterized by:

- pedestals that are bottomed on the bottom ring, so that gaps are left between the top of the pedestal and the slip housing;
- the pedestals are not constrained other than by the elastomer material of the seal element; and
- cap screws are provided to hold the bottom ring, seal element and slip housing together. The cap screws extend up through vertical bores formed in the bottom ring and seal element, to engage a threaded counterbore extending up into the base of the slip housing.

These features lead to problems. The elastomer can extrude into the gaps and be damaged. More axial holes through the elastomer have to be provided to accommodate the cap screws, thereby increasing seal element weakness. The pedestals are not rigidly guided and can become tilted. And finally, radially inward displacement of the pedestals can increase stress and cantilever loading inboard of the landing shoulder.

A current catalog sheet published by FMC Corporation of Chicago, entitled "Slip-type Casing Hangers", shows a C-29 model having a plurality of axial motion-limiting pins threaded into the slip housing. The pins extend down into counterbores or sockets formed in the bottom ring, but are not bottomed on the bottom ring. Cap screws extend vertically through the bottom ring and are threaded into the pins. Thus the pins are not free floating and the seal element is laterally immobile, as its movement is resisted by the pins. This means that the inboard and outboard portions of the seal element can be subjected to differing levels of compression and stress. For example, should the casing have a diameter larger than the nominal diameter, then the inboard portion of the seal element will be more highly compressed than the outboard portion. In addition, bending moments can be produced by hole misalignment and relative movement of the slip housing and lower ring under load.

The diameter of the suspended casing can vary +1% or −½% to a maximum of ⅛", relative to the nominal diameter. Thus it is desirable for the seal element to be able to shift laterally up to 1/16". If this does not occur, then either the inboard or outboard portions of the seal element will be additionally compressed when the casing load is applied.

With these problems in mind, we have designed a casing hanger assembly which incorporates motion-limiting pins. The assembly is designed to achieve the following:

- limit the pressure applied to the suspended casing string by the seal element;
- evenly distribute stresses in the seal element; and
- control the line-of-action of the applied load on the lower ring.

SUMMARY OF THE INVENTION

In the preferred form of the present casing hanger, the following features are combined:

- the slip housing and bottom ring are both counterbored at bottom and top respectively, to form a plurality of opposed pairs of sockets;
- the seal element is formed with vertical holes extending therethrough at points corresponding with the pairs of sockets;
- each pair of sockets and its corresponding seal element hole therefore cooperate to form a socket chamber;
- a pin is positioned in each socket chamber;
- each pin comprises an upper upset head and a lower reduced diameter shank—the head rides on the top surface of the seal element and is disposed in the slip housing socket—the shank is disposed in the seal element hole and the bottom ring socket;
- the top end of each pin is in contact with the top end surface of the slip housing counterbore, the pin side surface has a side clearance with the side wall surface of the socket chamber and its bottom end has a bottom clearance with the end surface of the bottom ring counterbore.

As a result of the foregoing arrangement, each pin is initially floating and free to move laterally a small amount within its socket chamber, in response to stresses present in the seal element. This serves to equalize stress distribution in the seal element arising from casing diameter variation. The pins are not initially fixed, so as to resist seal element deformation or movement. When the seal element is partly compressed, the clearance closes between each pin and the bottom ring, bottoming the pins and transferring load from the slip housing to the bottom ring through the pins, while limiting compression of the seal element. The utilization of top and bottom sockets having rigid walls provides sufficient guidance of the pins so that they do not become significantly misaligned. The utilization of a pin having an upset head enables the bottom clearance to be located in the bottom ring socket, spaced away from the element material.

In another preferred feature of the invention, an axial vertical bore is formed through some of the pins. A cap screw, connecting together the bottom ring, pin and slip housing, can extend through this pin bore. By passing the cap screws through the pins, the number of weakening holes formed through the seal element is reduced. The diameter of the pin bore is greater than that of the cap screw shank, so that a clearance is formed to better preserve the lateral shiftability of the pins.

Broadly stated, the invention is an improvement in a casing hanger assembly mounted for use in a wellhead to suspend casing from the internal landing shoulder of a casing bowl, said assembly comprising a bottom ring for seating on the landing shoulder, an annular elastomeric seal element seated on the bottom ring, an annular slip housing seated on the seal element, and slips, supported by the slip housing, for engaging and suspending the casing, said slip housing being operative to partly compress the seal element so that it expands radially and seals against the casing and casing bowl. The improvement comprises: said bottom ring having an annular top surface forming a plurality of downwardly extending sockets spaced along its length; said slip housing having an annular bottom surface forming a plurality of upwardly extending sockets positioned in opposed relation to the bottom ring sockets so that pairs of opposed sockets are provided; said seal element forming a plurality of vertical holes corresponding with the socket pairs so that each hole and its associated pair of opposed sockets combine to form a socket chamber having side, bottom and top surfaces; a plurality of rigid pins, each disposed in free floating condition in a socket chamber and extending through the full extent of the seal element hole forming part of that chamber, each such pin having side clearance with the chamber side surface and end clearance at one end of the chamber; whereby the un-compressed seal element and pins may shift laterally to accommodate casing having oversize diameter and the pins are operative to contact the bottom ring and transfer casing load from the slip housing to the bottom ring when the seal element is partly compressed, thereby limiting seal element compression.

BRIEF DESCRIPTION OF THE DRAWINGS

FIG. 3*a* is a side cross-sectional view of a solid pin;

FIG. 3*b* is a side cross-sectional view of a pin having a vertical bore for passing cap screws;

FIG. 4 is a side cross-sectional view of the of the annular seal element, taken through a pin-passing hole;

FIG. 5 is a top view of the seal element;

FIG. 6*a* is a partial side cross-sectional view through one pin and socket assembly illustrating a pin bottomed in its socket chamber as the seal element is compressed and accommodating a casing having a nominal diameter; and FIG. 6*b* is also a partial side cross-sectional view similar to FIG. 6*a*, but illustrating the accommodation of a casing having an oversized diameter.

DETAILED DESCRIPTION OF THE PREFERRED EMBODIMENT

Figure 1:
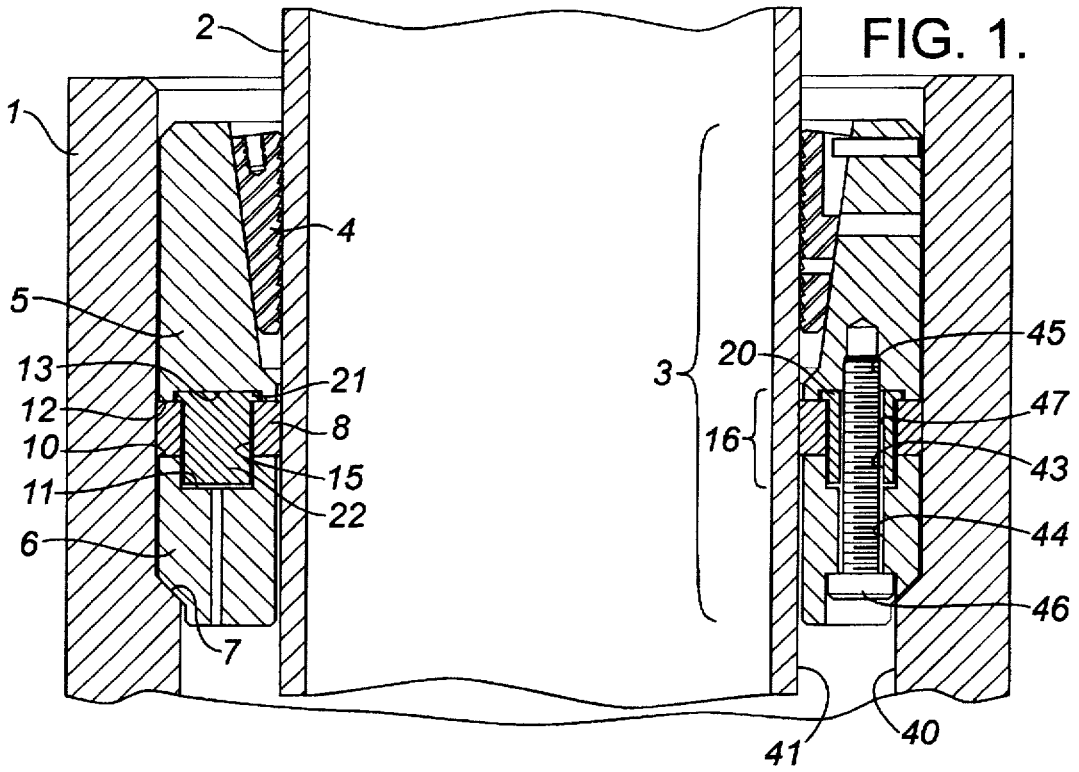
FIG. 1 is a side cross-sectional view of a casing bowl, a casing hanger assembly in accordance with the invention, and suspended casing.

Having reference to FIG. 1, a casing bowl 1 is shown suspending casing 2 by means of a casing hanger assembly 3. The casing hanger assembly 3 comprises slips 4 engaging the casing 2, a slip housing 5 supporting the slips 4, a bottom ring 6 seated on the internal landing shoulder 7 of the casing bowl 1 and an elastomer seal element 8 positioned between the slip housing and the bottom ring.

Figure 2:
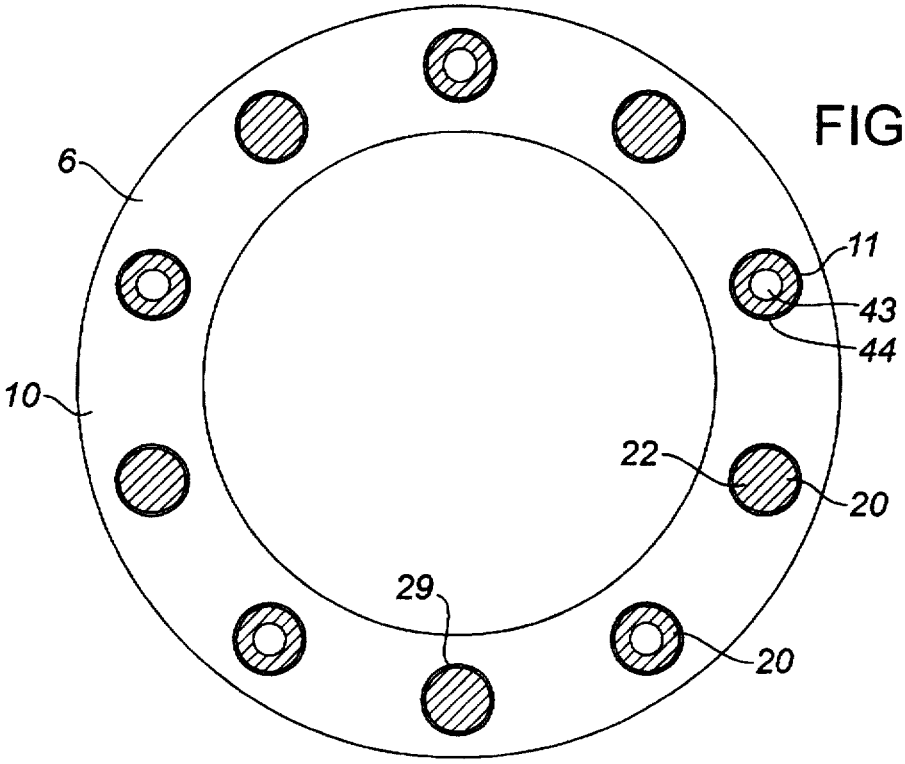
FIG. 2 is a top view of the bottom ring of FIG. 1. The pins are shown in cross-section in place in their respective socket chambers.

The top surface 10 of the bottom ring 6 has a plurality of downwardly extending counterbores or sockets 11. The sockets 11 are spaced along the length of the top surface 10, as shown in FIG. 2, and are located on a common concentric diameter.

The bottom surface 12 of the slip housing 5 has a plurality of upwardly extending sockets 13.

The slip housing sockets 13 and bottom ring sockets 11 are opposed or positioned so that pairs of aligned sockets are produced.

The seal element 8 is an annular body having a rectangular cross-section. A plurality of vertical holes 15 extend through the seal element 8. The holes 15 correspond with the socket pairs. Each associated pair of upper and bottom sockets 13, 11 and connecting hole 15 combine to form a socket chamber 16.

A rigid pin 20 is positioned in each socket chamber 16. As shown, the pin 20 has an enlarged head 21 and a downwardly depending shank 22 of reduced diameter. The head 21 is arranged to ride on the top surface 23 of the seal element 8. The head's upper surface 24 is in contact with the end surface 100 of the slip housing socket 13. It has a side clearance 30 with the slip housing socket side surface 31. The length and diameter of the shank 22 are selected so that the shank has a bottom clearance 26 with the end surface 27 of the ring socket 11 and a side clearance 28 with the socket's side surface 29.

Figure 6A:
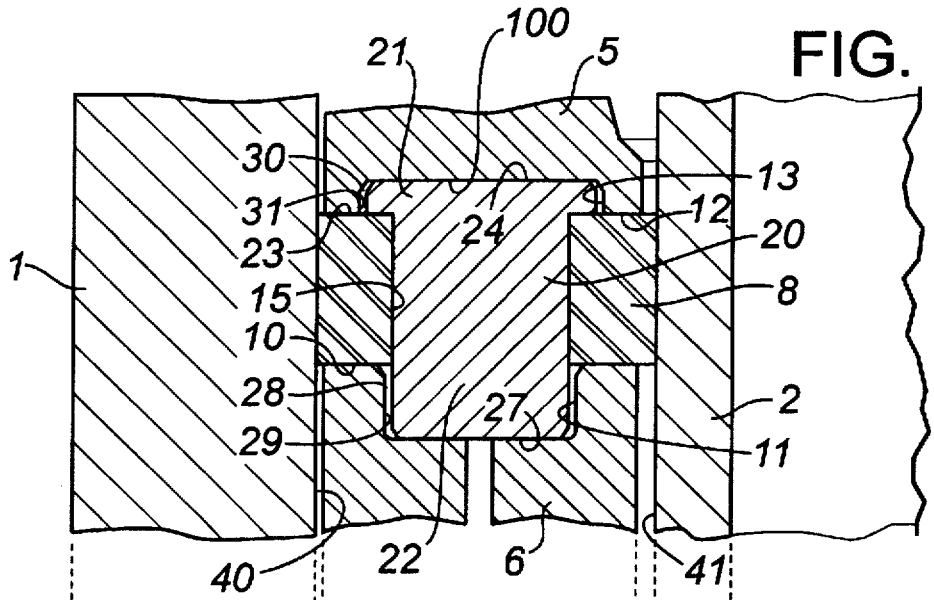
FIGS. 6*a* and 6*b* illustrate the compression limiting capability of the pins and the lateral movement capability of the seal element in response to diametral change in the casing. More specifically.
Figure 6B:
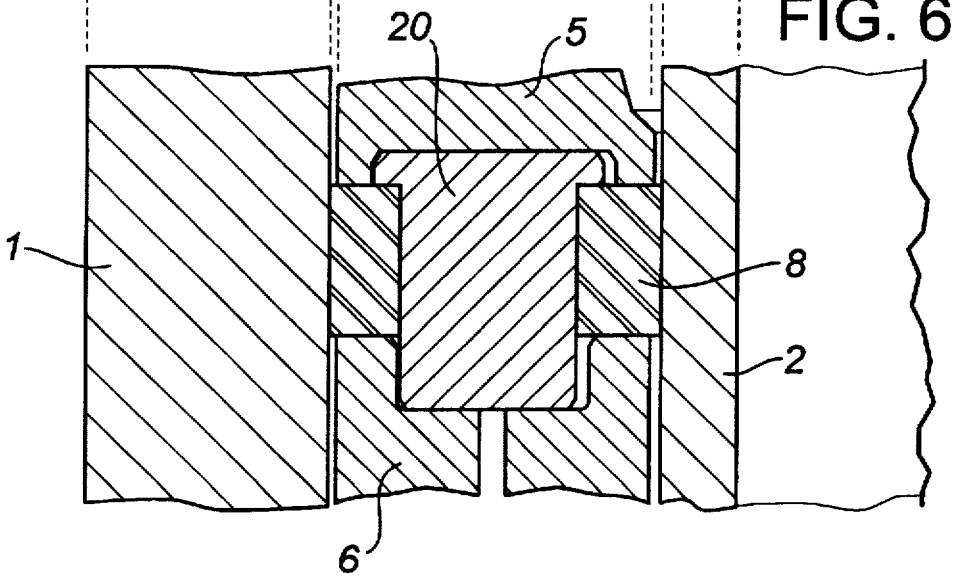

From the foregoing, it will be appreciated that the seal element 8 can shift laterally a limited amount relative to the pins 20, to accommodate oversized or undersized casing 2 (see FIGS. 6*a*, 6*b*). Prior to and during initial compression, the head and shank side clearances 30, 28 can relieve radial stresses in the seal element, by allowing its material to redistribute radially. For a nominal 9.625" outside diameter casing, having a maximum oversize casing diameter of 9.721" (+0.096" or 1%) the clearances 38,20 provided may be in the order of 0.096/2 or 0.048".

In addition, by providing a head 21 having a diameter greater than that of the seal element hole 15, the pin 20 is suspended on the un-compressed seal element, so that bottom clearance 26 can be provided between the base of the pin and the bottom ring 6.

The bottom clearance 26 (typically 1/16" to 1/32") and the compressibility of the seal element 8 are selected so that the seal element will extrude sufficiently to seal against the inner surface 40 of the casing bowl 1 and the outer surface 41 of the casing before the pins 20 bottom out on the top surface 10 of the bottom ring 6.

Four pins 20 are provided with a vertical bore 43 extending therethrough. Corresponding vertical bores 44 extend through the bottom ring 6 and threaded counterbores 45 are formed in the base of the slip housing 5. Cap screws 46 extend through bores 44, 43 and are threaded into counterbores 45 to tie the bottom ring 6, pins 20 and slip housing 5 together. A side clearance 47 is provided between each cap screw 46 and associated pin 20, to preserve the limited fre-floating capability of the pins.

The elastomer seal element 8 is preferably reinforced at its corners by right angle corner rings 50 formed of stiff material.

The important features of the assembly are the following:

pins that are not rigidly connected to the slip housing or bottom ring so that they are free-floating and do not initially rigidly restrain the flow of the rubber element;

the provision of counterbores or sockets with the pins being rigidly guided by the socket walls, said sockets providing a side clearance therewith so that there is some play to accommodate casing size variation; and the pins extending fully through the rubber element so that there are no horizontal gaps for the rubber to extrude into.

The preferred features are:

the provision of the enlarged pin head that rides on the rubber element so that the clearance is at the bottom of the socket; and the provision of vertical holes through the pins so that the cap screws may extend therethrough.

The scope of the invention is set forth in the claims now following.

The embodiments of the invention in which an exclusive property or privilege is claimed are defined as follows:

1. In a casing hanger assembly mounted for use in a wellhead to suspend casing from an internal landing shoulder of a casing bowl, said assembly comprising a bottom ring for seating on the landing shoulder, an annular elastomeric seal element seated on the bottom ring, an annular slip housing seated on the seal element and slips, supported by the slip housing, for engaging and suspending the casing, said slip housing being operative to partly compress the seal element so that it expands radially and seals against the casing and casing bowl, the improvement comprising:

said bottom ring having an annular top surface having a plurality of downwardly extending sockets spaced along its length;

said slip housing having an annular bottom surface having a plurality of upwardly extending sockets positioned in opposed relation to the bottom ring sockets so that pairs of opposed sockets are provided;

said seal element having a plurality of vertical holes corresponding with the socket pairs so that each hole and its associated pair of opposed sockets combine to form a socket chamber having side, bottom and top surfaces;

a plurality of rigid pins, each disposed in free floating condition in a socket chamber and extending through the full extent of the seal element hole forming part of that chamber, each such pin having side clearance with the chamber side surface and end clearance at one end of the chamber;

whereby the un-compressed seal element and pins may shift laterally to accommodate casing having oversize diameter, said pins being operative to contact the bottom ring and transfer casing load from the slip housing to the bottom ring when the seal element is partly compressed, thereby limiting seal element compression.

2. A casing hanger assembly for use in a wellhead to suspend casing from an internal landing shoulder of a casing bowl, comprising:

a bottom ring for seating on the landing shoulder, said ring having an annular top surface having a plurality of downwardly extending sockets spaced along its length;

an annular slip housing for positioning above the bottom ring in spaced relation thereto, said slip housing having a bottom surface having a plurality of upwardly extending sockets positioned to be in opposed relation to the bottom ring sockets so that pairs of opposed sockets are provided;

an annular elastomeric seal element positionable between the bottom ring and slip housing, said seal element having a plurality of vertical holes corresponding with the socket pairs so that each hole and its associated pair of opposed sockets combine to form a socket chamber having side, bottom and top surfaces;

a plurality of rigid pins, each positionable in one of the socket chambers, each pin having an upset head and a shank, the head being supported by the seal element, said head having a side clearance with the socket chamber side wall and being in contact with its top wall, the shank having side and bottom clearances with the socket chamber side and bottom surfaces when the casing hanger is assembled; and slips, supportable by the slip housing, for engaging and suspending the casing and transferring casing load to the slip housing;

whereby the un-compressed seal element and pins may shift laterally to accommodate casing having oversize diameter, said pins being operative to contact the bottom ring and transfer casing load from the slip housing to the bottom ring when the seal element is only partly compressed by downward travel of the loaded slip housing.

3. The casing hanger assembly as set forth in claim 2 wherein:

some of the pins have vertical bores extending therethrough;

the bottom ring has vertical bores extending therethrough corresponding with the pin bores;

the slip housing has vertical threaded bores, extending thereinto from its bottom surface, corresponding with the pin bores; and a plurality of cap screws are provided for connecting together the bottom ring, bored pins and slip housing by extending from the bottom ring, through the pins and into the slip housing.

4. The casing hanger assembly as set forth in claims 2 or 3 wherein the seal element has a rectangular cross-section and right angle corner rings formed of stiff material are mounted to the corners of the seal element to reinforce it.

* * * * *